United States Patent [19]

Dickakian

[11] Patent Number: 4,931,164

[45] Date of Patent: Jun. 5, 1990

[54] ANTIFOULANT ADDITIVE FOR LIGHT END HYDROCARBONS

[75] Inventor: Ghazi B. Dickakian, Kingwood, Tex.

[73] Assignee: Exxon Chemical Patents Inc., Linden, N.J.

[21] Appl. No.: 270,545

[22] Filed: Nov. 14, 1988

[51] Int. Cl.[5] ..... C10G 9/16

[52] U.S. Cl. ..... 208/48 AA; 585/950

[58] Field of Search ..... 208/48 AA; 585/950

[56] References Cited

U.S. PATENT DOCUMENTS

| | | | |
|---|---|---|---|
| 3,609,076 | 9/1971 | Sabol et al. | 44/51 |
| 3,920,572 | 11/1975 | King et al. | 252/334 |
| 3,933,662 | 1/1976 | Lowe | 252/52 A |
| 4,176,045 | 11/1979 | Leftin et al. | 585/950 |
| 4,297,150 | 10/1981 | Foster et al. | 585/950 |
| 4,454,021 | 6/1984 | Walanabe et al. | 585/950 |
| 4,751,187 | 6/1988 | Dickakian | 208/4 AA |
| 4,752,587 | 6/1988 | Dickakian | 208/4 AAA |

*Primary Examiner*—Helane Myers

*Attorney, Agent, or Firm*—R. L. Graham; J. F. Hunt

[57] ABSTRACT

Low temperature asphaltene fouling is inhibited in highly paraffinic crude oil, liquified hydrocarbon gases (e.g. LPG, condensates) and blends thereof by the incorporation of an inhibiting amount of an oil soluble overbased magnesium sulfonate.

16 Claims, No Drawings

ANTIFOULANT ADDITIVE FOR LIGHT END HYDROCARBONS

BACKGROUND OF THE INVENTION

This invention relates generally to a method for preventing antifoulant in light end hydrocarbons or blends of crude oil and light in hydrocarbons.

All crude oils are composed of two major components, a low molecular weight oil fraction (aromatic and/or saturates), and a high molecular weight fraction insoluble in paraffinic solvents. This fraction is called $C_7$-asphaltenes. As used herein the term "asphaltenes" refers to these high molecular weight paraffinic insoluble asphaltenes. Asphaltenes are characterized by a high average molecular weight (about 1000 and up to 5,000) and very broad molecular weight distribution (up to 10,000) and high coking tendency. Asphaltenes fouling refers to the $C_7$-asphaltenes precipitating out in pipelines, storage vessels, transport vessels and especially in process equipment (e.g. heat exchangers, reboilers, etc.) operating at elevated temperatures.

Highly paraffinic hydrocarbon liquids (those with no aromatics) generally do not present fouling problems in and of themselves because of the absence of asphaltenes. However, it frequently is desirable, if not necessary, to combine the paraffinic liquids such as ethane, propane, LPG's, condensates, etc. with crude oil for purposes of transporting or storing the paraffinic hydrocarbon liquid. The addition to crude oil, particularly crude low in aromatics, frequently results in equipment fouling during transport and storage and subsequent processing as when the paraffinic hydrocarbon liquid is separated from the crude oil as by distillation separation. The separation operation is normally carried out at temperatures ranging from 100° to 400° F., more usually at 200° F. to 400° F. The presence of even small quantities of asphaltenes in the blend causes fouling in the heat exchangers and distillation equipment (e.g. reboilers).

It has recently been discovered that certain light end hydrocarbons, such as liquified natural gas, present asphaltene fouling tendencies with minute quantities of high molecular weight asphaltenes present (from 10 to 10,000 ppm). The liquid hydrocarbon gases may also be subjected to fraction separation processes at elevated temperatures (100° F.–400° F.) which appears to accelerate asphaltene fouling.

The present invention relates to the use of overbased magnesium sulfonate as an asphaltene antifoulant for crude oil/paraffinic hydrocarbon liquid blends and liquified hydrocarbons. The term liquified petroleum gases include liquified petroleum gas (LPG), natural gas liquid (NGL), as well as $C_2$–$C_7$ alkanes such as ethane, propane, butane, etc.

U.S. Pat. No. 3,328,283 discloses the use of organic sulfonic acid or alkyl aryl sulfonate salt in combination with a partial ester. U.S. Pat. No. 3,328,284 discloses the use of an alkyl aryl sulfonate with an oxy alkylated phenolic compound. In both of these prior art patents, the sulfonate is not overbased. Moreover, the alkyl aryl sulfonates appears to function as an adjunct to the main antifouling agent, and not as an antifoulant per se.

Overbased alkyl aryl sulfonates have been used as antifoulants for heat transfer oils. Heat transfer oils, however, are refined oils that do not contain asphaltenes and therefore are not particularly relevant to the present invention which is directed specifically at mitigating asphaltene fouling. The transfer oil patents of the prior art include U.S. Pat. Nos. 3,554,914, 3,920,572, and 3,958,624.

SUMMARY OF THE INVENTION

It has been discovered that asphaltenes fouling of paraffin hydrocarbon liquids (or their blends with paraffinic crude oils) containing small amounts of $C_7$-asphaltenes is eliminated or substantially reduced by incorporating into the liquid an effective amount of an overbased magnesium alkyl aromatic sulfonate. The sulfonate inhibitor is particularly effective in the storage, transport and heat distillation (deethanizers and depropanizers at 100° F.–400° F.) of the paraffin hydrocarbon liquid.

The paraffin hydrocarbon liquids include liquified hydrocarbon gases or blends of from 40 to 99 vol% of a paraffinic crude oil and from 1 to 60 vol% of liquified hydrocarbon gases such as $C_2$ to $C_7$ (preferably $C_3$–$C_7$) alkanes, liquified petroleum gas (LPG), natural gas liquid (NGL) and condensates.

The term paraffin when used to characterize liquid or crude oil means liquid or crude oil being composed of predominantly aliphatic components (95–98% or greater) with minor amounts (less than 2–5 wt%) aromatic components.

The paraffin hydrocarbon liquid in which the present invention is applicable includes minute quantities of $C_7$ asphaltenes (less than 10,000 ppm), usually between 10 and 10,000 ppm. The asphaltenes can be determined by n-heptane insoluble-toluene soluble fraction techniques.

The preferred sulfonate is magnesium overbased magnesium alkyl benzene sulfonate wherein the alkyl group contains from 12 to 45 carbon atoms.

The present invention is specifically directed at low temperature (not greater than 400° F.) asphaltene fouling by paraffin hydrocarbons, such as encountered in pipelines, storage and low temperature distillation as in deethanizers and depropanizers.

DESCRIPTION OF THE PREFERRED EMBODIMENTS

In the transporting and storage of oil field produced fluids such as crude oil and separated gas, it frequently becomes economical to blend the crude oil and liquified hydrocarbon gases for transportation. At the destination, the liquified petroleum products may be separated from the crude oil. A serious problem associated with this process, however, is the fouling tendency of the blend. Paraffinic hydrocarbon liquids are incompatible with asphaltenes so that upon blending with the crude oil, particularly paraffinic crudes, the fouling tendency of the crude oil may be increased. The fouling tendency is further exacerbated at thermal separation temperatures such as those encountered in deethanzers and depropanizers. Although the temperature of these thermal processes are relatively low (400° F. or less), they nevertheless create fouling problems in heat exchangers and reboilers.

As mentioned above, it has surprisingly been discovered that $C_7$-asphaltene fouling is present in transporting, storing, and distilling of paraffin liquids even with minute quantities of $C_7$-asphaltenes (10–10,000 ppm).

In accordance with the present invention, an effective amount of an antifoulant agent is added to the paraffinic hydrocarbon liquid to mitigate the fouling in storage, transportation, and particularly in the thermal separation process. The antifoulant is an overbased sulfonate, preferably a magnesium overbased alkyl aromatic magnesium sulfonate.

Overbased magnesium sulfonates are prepared from sulfonic acids or mixtures thereof, or their metal salts. Suitable oil soluble sulfonic acids are preferably aromatic compounds. Especially suitable sulfonic acids are the oil soluble petroleum sulfonic acids commonly referred to as "mahogany acids", aryl sulfonic acids and alkaryl sulfonic acids. Examples of such acids, polyolefin alkylated benzene sulfonic acids, such as polybutene alkylated benzene sulfonic acids and polypropylene alkylated benzene sulfonic acids. Other suitable examples include diparaffin wax-substituted phenol sulfonic acids, acetyl chlorobenzene sulfonic acids, cetyl-phenol disulphide sulfonic acids, cetyl-phenol mono sulphide sulfonic acids and cetoxy capryl benzene sulfonic acids. Many oil soluble sulfonic acids are described at length in the literature. See for examples, U.S. Pat. No. 2,616,604, No. 2,626,207 and No. 2,767,209. The neutral sulfonates which are overbased preferably have the following formula

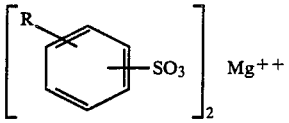

wherein R is an alkyl or haloalkyl having from 12 to 45 carbon atoms, preferably between 16 to 30 carbon atoms, most preferably from 8 to 28 carbon atoms. R preferably is a straight chain aliphatic hydrocarbon radical which may have two homologs present, but may be a branched or mixed alkyl group. The benzene ring of the sulfonic salt may have in addition to R other substituents such as alkyl, hydroxy, halo, nitro groups, or mixtures of these. Typical examples of the sulfonic acids used in preparing the sulfonates include in addition to those mentioned above are alkyl toluene sulfonic acid, alkyl xylene sulfonic acid and the dialkyl benzene sulfonic acid such di-dodecyl benzene sulfonic acid.

The molecular weight of the neutral magnesium alkyl aryl sulfonate may range from 200 to 3000, with 600 to 2000 being preferred for the alkyl benzene sulfonates with 600 to 1200 being the most preferred.

The position of the alkyl group and the sulfonate on the benzene ring in relation to each other is not critical. Secondary alkyl groups may also be present. the alkyl benzene magnesium sulfonate is overbased with an alkaline earth metal, preferably magnesium.

The magnesium overbased alkyl benzene magnesium sulfonates may be prepared by processes described in the literature. An example of one process is as follows:

(a) reacting benzene with an olefin by a simple alkylation process;

(b) sulfonating the alkyl benzene to form neutral alkyl benzene magnesium sulfonic acid;

(c) overbasing the alkyl benzene sulfonic acid with magnesium to produce a product having a total base number (TBN) between 50 and 700 mg KOH/gram, preferably between 300 and 600 MG KOH/gram.

Another overbasing method which is described in UK Patent No. 1,551,820 employs a magnesium alkoxy alkoxide as an intermediate in magnesium overbasing. This route to magnesium overbasing is not now used extensively.

The most common procedure for the preparation of overbased magnesium sulfonate is from magnesium oxide, as described generally below:

(1) Adding to an inert, volatile solvent which may be aliphatic, aromatic or chlorinated, (a) an oil soluble sulfonic acid or salt thereof (b) sufficient magnesium oxide to form the desired product, (c) an hydroxy containing compound. (e.g. methanol)

(d) water, (e) a non-volatile diluent oil, and (f) a promoter.

(2) Treating the above mixture with carbon dioxide, at a temperature of between 50° F. and the reflux temperature of the mixture, until the absorption of carbon dioxide virtually ceases. Usually 0.5 to 1.1 moles and more usually 0.6 to 0.9 moles of carbon dioxide are absorbed by the mixture for every mole of overbasing magnesium.

(3) The volatile components are then removed by distillation to typically 160° C. and finally the mixture is subjected to a vacuum to ensure complete removal of the volatiles.

(4) The unreacted solids are then removed by either filtration or centrifugation.

(5) Further addition of diluent oil may be added to obtain the desired product.

Many different promoters may be employed to facilitate the reaction towards forming the overbased magnesium sulfonates. The role of some of these promoters is not fully understood, but without them the rate and degree of reaction is substantially reduced. Typical promoters include amines (e.g. ethylene diamine), ammonia or ammonium compounds, carboxylic acids, amine salts of carboxylic acids, and succinic anhydride derivatives. These promoters are described in the patent literature.

The use of sufficient sulfonic acid or its salt, and sufficient magnesium oxide with one of the promoters are used in the above process produces a high alkalinity overbased magnesium sulfonates with Total Base Numbers of 100 to 700, preferably 300 to 600 mg KOH/g.

The antifoulant may be included in an antifoulant package which includes other additives such as an organic dispersant, antioxident, free radical scavenger additives, wax crystal modifiers, and polycondensed aromatics.

In carrying out the present invention with only liquified hydrocarbon gases, it is only necessary to determine the concentration of $C_7$ asphaltenes. If the liquid is pure containing no asphaltenes, then of course no treatment is necessary. However, if the liquid contains from 10 to 10,000 ppm $C_7$ asphaltenes, it may be necessary to determine the fouling tendency of such liquid and the optimum concentration of the antifoulant. Generally from 10 ppm to 1000 ppm, preferably 10 to 500 ppm, of the overbased sulfonate will be adequate to inhibit asphaltenes fouling in the transport and storage and low temperature (100°-400° F.) thermal treatment (if any) of liquified hydrocarbon liquids.

In the application of the present invention in the blending of paraffinic crude with liquified petroleum gases, it is necessary to determine the blend ratio of crude oil to the liquified gas. The liquified gas generally has less aromatics than the crude oil so that there is an upper limit of the liquified gas which can be tolerated. Excess liquified gas will reduce the aromatic/asphaltene ratio and increase fouling. Laboratory tests have shown that the blend can tolerate up to about 60 vol% of liquified petroleum gas based on the total blend volume. With the proper ratio selected, optimum treatment rate of the antifoulant can be determined. From 50 to 200 ppm of the overbased sulfonate are satisfactory for most blends.

The fouling tendency of the blend prior to transporting or storage can be determined by the use of the processes disclosed in applicant's copending application U.S. Ser. Nos. 723,598, 830,386, 910,910, 024,730, and 048,167, the contents of which are incorporated herein by reference.

EXPERIMENTS

Examples 1 and 2: Treatment of Liquified Natural Gas

The Thermal Fouling Test (TFT) was used to measure the fouling characteristics (deposit formation on hot metal surface) and mitigation of fouling by antifoulant additives. The TFT test procedure is described in the above copending applications.

The TFT test was carried out by pumping NGL into a heat exchanger containing a heater tube heated to the desired test temperature. The liquid is circulated through the heat exchanger to form sufficient deposits. This amount of deposits decreases heat transfer. and results in increased ΔT.

Untreated and treated NGL streams were tested by the TFT test. Results are summarized in the following table.

| | EXAMPLE 1 Untreated NGL | EXAMPLE 2 Treated NGL |
|---|---|---|
| Antifoulant | None | 100 ppm of antifoulant A |
| TFT Metal Temp. (°F.) | 500 | 500 |
| Flow Rate (cc/min.) | 3.0 | 3.0 |
| Pressure (psig) | 850 | 850 |
| Test time (hours) | 3.0 | 3.0 |
| Thermal Fouling (ΔT, °F.) | 41 | 7 |
| Deposit Weight (mg) | 6.0 | 2.8 |

Antifoulant A was magnesium carbonate overbased magnesium alkyl benzene sulfonate, wherein the alkyl group was a mixture of $C_{24}$–$C_{28}$.

Examples 3 and 4: Treatment of NGL/Crude Oil Blend

A mixture of NGL and paraffinic crude oil (50% NGL) was tested by the TFT.

The NGL/crude oil mixture was then treated with 100 ppm of Antifoulant A and tested again at the same conditions. Test results are summarized in the following table.

| | Example 3 Untreated NGL/crude oil | Example 4 Treated NGL/crude oil |
|---|---|---|
| Antifoulant | None | 100 ppm of antifoulant |
| TFT Heater Temperature | 400 | 400 |
| Flow Rate (cc/min) | 3.0 | 3.0 |
| Test time (hours) | 3.0 | 3.0 |
| Pressure (psig) | 850 | 850 |
| Thermal Fouling (ΔT, °F.) | 44 | 9 |
| Deposit Weight (mg) | 22.4 | 4.5 |

What is claimed is:

1. A method of treating a highly paraffinic hydrocarbon liquid containing not more than 5 wt% aromatics and from 10 to 10,000 ppm high molecular weight asphaltenes to prevent asphaltene fouling of equipment at temperatures below 400° F., said method comprising adding to the hydrocarbon liquid not less than 10 ppm and not more than 200 ppm of an oil soluble overbased magnesium alkyl aromatic sulfonate to inhibit asphaltene fouling.

2. The method of claim 1 wherein the sulfonate is overbased with magnesium.

3. The method of claim 1 wherein the sulfonate is magnesium overbased magnesium alkyl benzene sulfonate.

4. The method of claim 3 wherein the alkyl group contains from 12 to 45 carbon atoms.

5. The method of claim 3 wherein the alkyl group contains from 16 to 30 carbon atoms.

6. The method of claim 2 wherein the magnesium overbased sulfonate has an alkalinity of 100 to 700 mg KOH/g.

7. The method of claim 1 wherein the overbased sulfonate has an alkalinity (Total Base Number) the overbased of 300 to 600 mg KOH/g.

8. The method of claim 1 wherein the magnesium alkyl aromatic sulfonate has a molecular weight of between 200 and 3000.

9. The method of claim 1 wherein the overbased magnesium sulfonate has the following formula

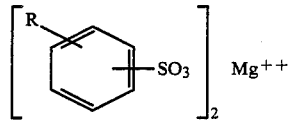

where R is an alkyl having from 12 to 45 carbon atoms.

10. The method of claim 3 wherein the sulfonate is present in a concentration of 50 to 200 ppm based on the weight of the liquid stream.

11. In a method wherein a highly paraffinic hydrocarbon liquid containing from 10 to 10,000 ppm asphaltenes and less than 5 wt% aromatics is transported in a pipeline, an improved method for inhibiting asphaltene fouling of the pipeline by the liquid which comprises adding to the paraffin hydrocarbon liquid not less than 10 ppm and not more than 200 ppm of an oil soluble overbased magnesium alkyl aromatic sulfonate.

12. The method of claim 11 wherein the hydrocarbon liquid is a blend of from 1 to 60 vol% of a liquified hydrocarbon gas and from 40 to 99 vol% of a highly paraffinic crude oil.

13. The method of claim 12 wherein the liquified hydrocarbon gas is selected from the group consisting of $C_2$ to $C_7$ alkanes, liquified petroleum gas (LPG), natural gas liquid (NGL) and condensates.

14. The method of claim 13 wherein the liquified hydrocarbon gas is selected from the group consisting of liquified petroleum gas (LPG), natural gas liquid (NGL) and condensates.

15. In a process wherein a blend of paraffinic crude oil and liquified hydrocarbon gas is transported and then separated by thermal distillation at a temperature of between 100° and 400° F., an improved method for inhibiting asphaltene fouling in the pipe line and thermal distillation by incorporating not less than 10 ppm and not more than 200 ppm of an oil soluble magnesium overbased magnesium alkyl aromatic sulfonate.

16. The method of claim 15 wherein the blend contains from 10 to 1000 ppm asphaltenes and wherein the blend comprises not more than 50 vol % of said liquified hydrocarbon gas.

* * * * *